US008528216B2

(12) United States Patent
Melton et al.

(10) Patent No.: US 8,528,216 B2
(45) Date of Patent: Sep. 10, 2013

(54) ATTACHMENT COMB FOR A HAIR CLIPPER

(75) Inventors: Scott A. Melton, Erie, IL (US); Keith W. Dirks, Sterling, IL (US); Michael Eddinger, Rock Falls, IL (US); Brian W. Smith, Sterling, IL (US); Edward Brill, Sterling, IL (US); Martin Niebergall, Villingen-Schwenningen (DE); Heinrich Schwer, Schonach (DE)

(73) Assignee: Wahl Clipper Corporation, Sterling, IL (US)

( * ) Notice: Subject to any disclaimer, the term of this patent is extended or adjusted under 35 U.S.C. 154(b) by 185 days.

(21) Appl. No.: 13/036,417

(22) Filed: Feb. 28, 2011

(65) Prior Publication Data

US 2011/0146084 A1 Jun. 23, 2011

Related U.S. Application Data

(63) Continuation of application No. 11/482,411, filed on Jul. 7, 2006, now Pat. No. 7,918,029.

(51) Int. Cl.
*B26B 19/00* (2006.01)

(52) U.S. Cl.
USPC ..... 30/233.5; 30/233; 30/200

(58) Field of Classification Search
USPC ..... 30/233.5, 200, 201, 202, 54, 55, 30/233; 40/671
See application file for complete search history.

(56) References Cited

U.S. PATENT DOCUMENTS

| | | | | |
|---|---|---|---|---|
| 1,788,211 | A * | 1/1931 | Steiner | 40/662 |
| 2,481,097 | A | 9/1949 | Fewins | |
| 2,618,060 | A | 11/1952 | Giorgi | |
| 2,687,134 | A * | 8/1954 | Bauer | 132/142 |
| 2,747,277 | A | 5/1956 | Esposito | |
| 2,918,723 | A | 12/1959 | Levin | |
| 3,320,668 | A | 5/1967 | Pucino | |
| 3,344,520 | A * | 10/1967 | Williams | 30/200 |
| 3,844,036 | A | 10/1974 | Wahl et al. | |
| 3,969,819 | A | 7/1976 | Pepera | |
| 4,118,863 | A | 10/1978 | Sandy | |
| 4,218,038 | A | 8/1980 | Garneau, Sr. | |
| 4,614,036 | A * | 9/1986 | Haraguchi | 30/200 |

(Continued)

FOREIGN PATENT DOCUMENTS

| | | |
|---|---|---|
| GB | 2134764 | 8/1984 |
| JP | 1212588 | 8/1989 |
| JP | 05220011 | 8/1993 |

OTHER PUBLICATIONS

Actual Production Comb Disclosed by, U.S. Patent No. 4,622,745, Nov. 18, 1986.

(Continued)

*Primary Examiner* — Ghassem Alie
*Assistant Examiner* — Bharat C Patel
(74) *Attorney, Agent, or Firm* — Greer, Burns & Crain, Ltd.

(57) ABSTRACT

An attachment comb for a hair clipper includes a base portion constructed and arranged for releasably engaging the hair clipper, and a plurality of teeth extending from the base portion, each of the teeth including a body portion defined between an upper peripheral edge and a lower peripheral edge, a proximal end adjacent the base portion and a distal end opposite thereof, wherein the body portion includes at least one formation for retaining hair.

14 Claims, 4 Drawing Sheets

(56) References Cited

U.S. PATENT DOCUMENTS

| | | | | |
|---|---|---|---|---|
| 4,622,745 | A | 11/1986 | Wahl | |
| 4,936,606 | A * | 6/1990 | Moss | 283/70 |
| 4,970,990 | A * | 11/1990 | Wilhelmi | 119/601 |
| 5,078,928 | A | 1/1992 | Balster et al. | |
| 5,131,418 | A * | 7/1992 | Vaccaro | 132/213.1 |
| 5,682,680 | A | 11/1997 | Haussermann et al. | |
| 5,898,999 | A * | 5/1999 | Chaouachi et al. | 30/201 |
| 5,937,526 | A * | 8/1999 | Wahl et al. | 30/201 |
| 5,979,060 | A | 11/1999 | Holzbauer et al. | |
| 6,073,350 | A | 6/2000 | Elston et al. | |
| 6,079,103 | A * | 6/2000 | Melton et al. | 30/43.92 |
| 6,807,736 | B2 * | 10/2004 | Langley | 30/123 |
| 6,968,623 | B2 | 11/2005 | Braun et al. | |
| 7,249,416 | B2 | 7/2007 | Yamaguchi et al. | |
| 7,322,108 | B2 | 1/2008 | Caldwell | |
| 2002/0053141 | A1 | 5/2002 | Laube | |
| 2003/0056374 | A1 | 3/2003 | Langley | |
| 2004/0181988 | A1 * | 9/2004 | Ingraham | 40/671 |
| 2004/0250428 | A1 | 12/2004 | Melton | |
| 2005/0138817 | A1 * | 6/2005 | Yamaguchi et al. | 30/233 |
| 2006/0042095 | A1 * | 3/2006 | Yamaguchi et al. | 30/201 |
| 2007/0163391 | A1 | 7/2007 | Mathieu et al. | |

OTHER PUBLICATIONS

Actual Production Comb Disclosed by, U.S. Patent No. 6,079,103, Jun. 27, 2000.

Actual Production Comb Disclosed by, U.S. Patent No. 2005/0138817, Jun. 30, 2005.

* cited by examiner

ATTACHMENT COMB FOR A HAIR CLIPPER

RELATED APPLICATION

This application is a continuation of, and claims Section 120 priority from, U.S. Ser. No. 11/482,411, filed Jul. 7, 2006.

BACKGROUND OF THE INVENTION

The present invention relates generally to an attachment comb for use with a hair clipper, and more particularly to an attachment comb having a plurality of teeth configured for passing more easily through the hair.

In general, most attachment combs include a set of teeth that extend away from the blade area of the hair clipper. The teeth are designed to contact the skin of the head to maintain the cutting blades at a relatively fixed distance from the skin, so that hair is cut to a uniform length. The bottom edges of the attachment comb are generally pushed along the surface of the scalp, and the teeth guide the hair towards the cutting blades of the clipper.

One problem that arises in typical attachment combs is that hair can fall out of the comb during operation, preventing a uniform cut. Although the teeth are configured for guiding the hair towards the cutting blade, longer hair, and especially fine or wispy hair, can slip out of the teeth as the comb is pushed along the scalp, preventing the hair from being cut.

Current attachment combs also typically include a set of uniformly shaped, full-sized teeth. However, such configurations generally require a larger amount of material to manufacture the comb, increasing production costs. In addition, the configuration of the teeth increases the weight of the comb, requiring a greater pushing force to move the comb along the scalp.

As hair is cut by the clipper, it is fed through the teeth to the blade set, which is attached to the comb at the base portion of the comb. However, in current attachment combs, as the hair is fed through the teeth to the base portion, hair at the base portion is often bunched up or backed up, causing the hair to be pushed away from the blade set, preventing the hair from being cut. Another potential problem is that hair can become caught on the attachment comb due to interference of the comb teeth with the blade set. This can cause damage to the hair, and can also cause the blade set to cut some hair twice if previously cut hair is prevented from exiting the comb.

Accordingly, there exists a need for an improved attachment comb that prevents hair from falling out of the comb before it is cut. There is also a need for an improved attachment comb that is relatively inexpensive to manufacture, but that also provides the required support to the hair being cut. Further, there is a need for an improved attachment comb that prevents hair backup on the base portion, so that more of the hair that is fed into the teeth will be cut. Finally, there is a need for an improved attachment comb that allows hair to easily fall out of the comb once it has been cut.

BRIEF SUMMARY OF THE INVENTION

The present attachment comb for a hair clipper meets or exceeds the above-listed needs. Specifically, the present attachment comb is provided with formations for preventing hair from falling out of the comb teeth before it is cut. Also, the comb provides sufficient support to efficiently cut hair, but is also less expensive to manufacture than current combs. Further, the present attachment comb prevents hair from backing up on the base portion, allowing more of the hair to be cut. Finally, the present attachment comb allows hair that has already been cut to exit the comb so it does not interfere with the blade set or the remainder of hair to be cut.

Specifically, an attachment comb for a hair clipper includes a base portion constructed and arranged for releasably engaging the hair clipper, and a plurality of teeth extending from the base portion, each of the teeth including a body portion defined between an upper peripheral edge and a lower peripheral edge, a proximal end adjacent the base portion and a distal end at an opposite end thereof, wherein the body portion includes at least one formation for retaining hair within the comb prior to cutting.

DETAILED DESCRIPTION OF THE INVENTION

Figure 1:
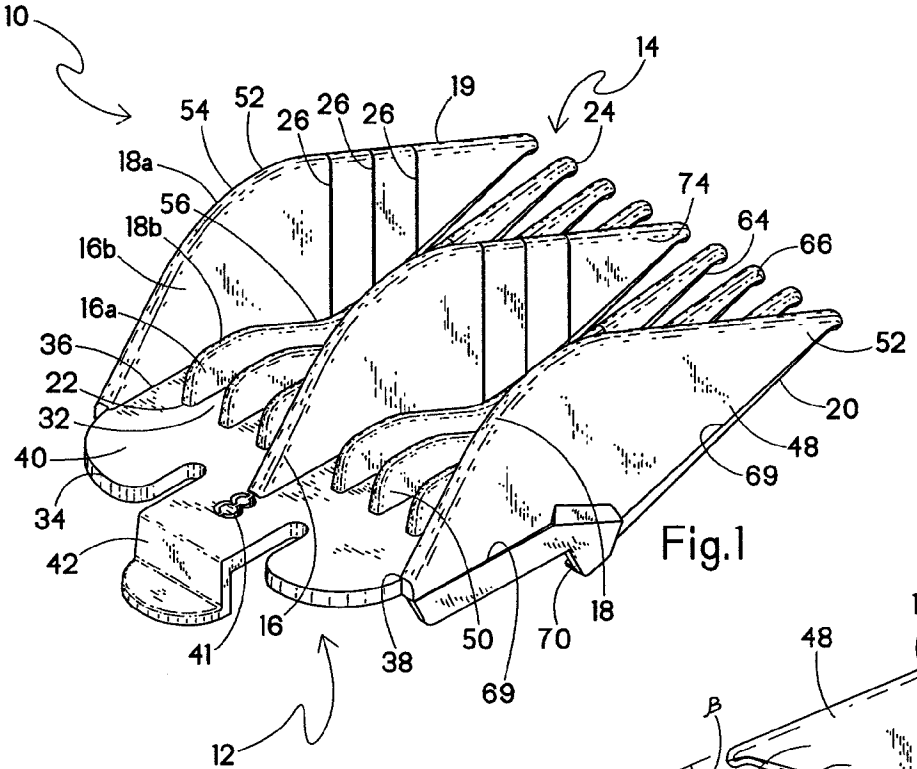
FIG. 1 is a top perspective view of an attachment comb according to the present invention.
Figure 8:
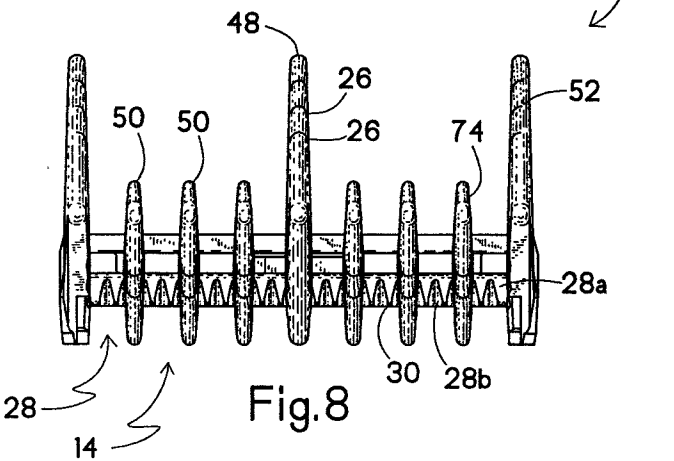
FIG. 8 is a front view of the attachment comb of FIG. 1 when assembled to a blade set of a hair clipper.
Figure 10:
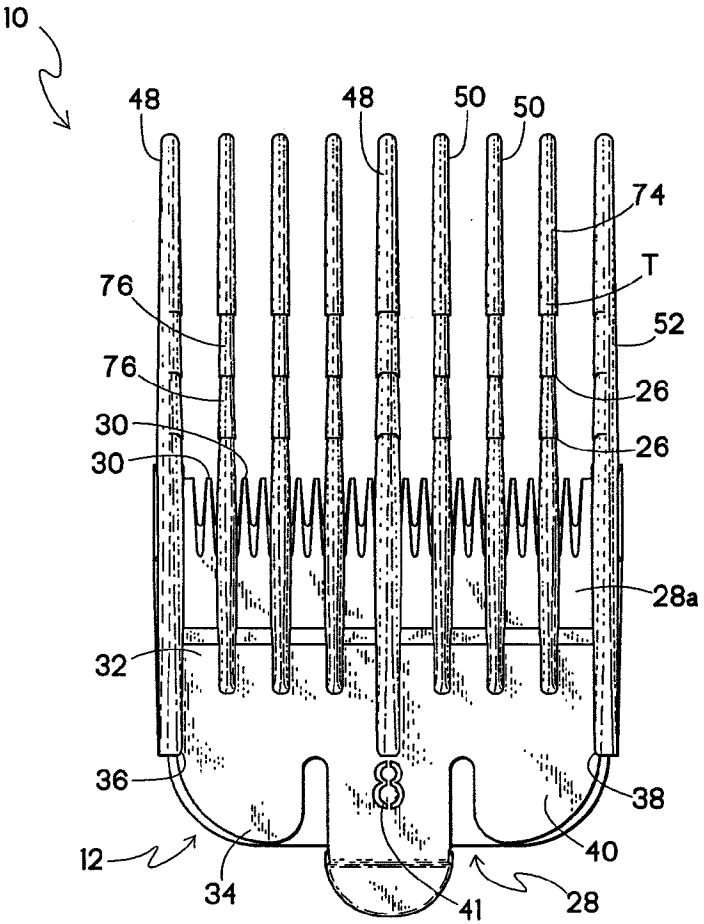
FIG. 10 is a top view of the assembly of FIG. 8.

Referring now to FIG. 1, an attachment comb for a hair clipper is generally designated 10 and includes a base portion 12 constructed and arranged for releasably engaging the hair clipper 11 (FIG. 9), and a plurality of teeth 14 extending from the base portion, each of the teeth including a body portion 16 defined between an upper peripheral edge 18 and a lower peripheral edge 20, a proximal end 22 adjacent the base portion and a distal end 24 at an opposite end. The body portion 16 includes at least one formation 26 for retaining hair within the comb prior to cutting. In the preferred embodiment, the formations 26 are provided as a plurality of ridges. The comb 10 is preferably injection-molded from a lightweight plastic, as known in the art. However, it is recognized that other materials and methods of manufacture may be suitable. The hair clipper 11 generally includes a blade set 28 having a pair of blades 28*a*, 28*b*, referring respectively to stationary and moving blades, each of the blades having a set of blade teeth 30. The blade set 28 is constructed and arranged for releasably engaging the base portion 12, as shown in FIGS. 8-10.

Figure 5:
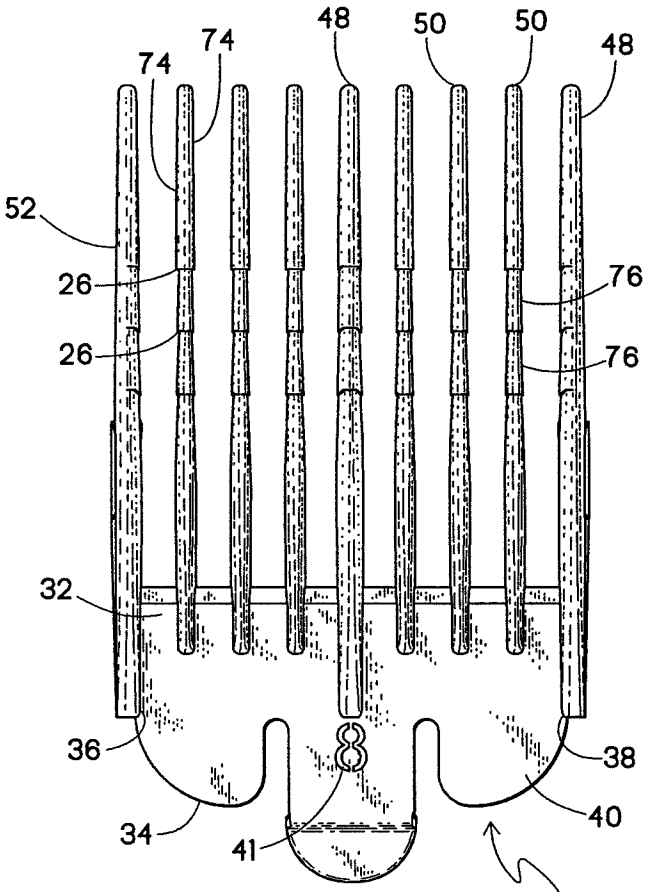
FIG. 5 is a top view of the attachment comb of FIG. 1.
Figure 3:
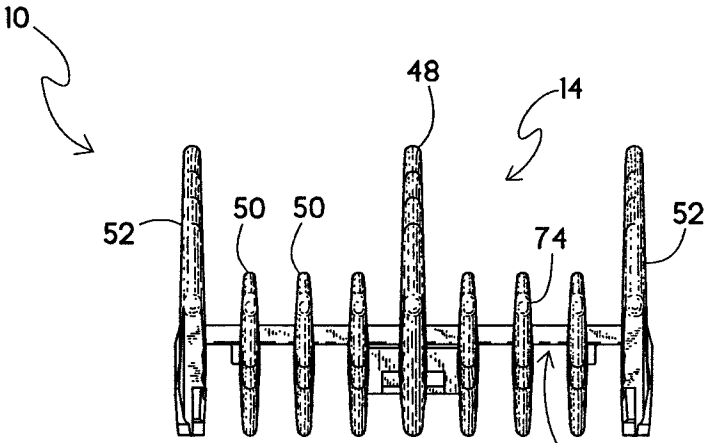
FIG. 3 is a front view of the attachment comb of FIG. 1.
Figure 4:
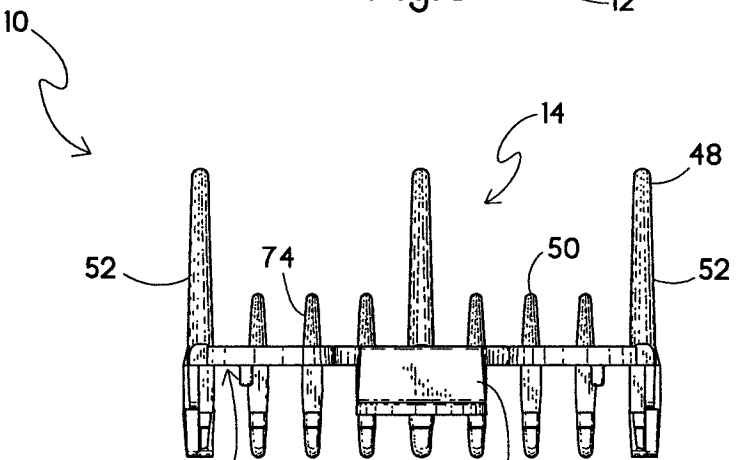
FIG. 4 is a rear view of the attachment comb of FIG. 1.

Referring now to FIGS. 1 and 5, the base portion 12 extends between a front edge 32, a rear edge 34 and two outer side edges 36, 38 to form a generally horizontal plane 40. The base portion 12 of the attachment comb 10 is approximately 3/16 of an inch shorter between the front edge 32 and the rear edge 34 than a similar dimension in current combs. It is contemplated that this arrangement allows most of the hair to be cut, unlike the longer horizontal planes generally found in current combs, which can cause hair, especially longer hair, to be pushed up against the front edge of the base portion, causing a back-up of hair on the horizontal plane 40, and pushing the hair out of the comb before it is cut.

Referring to FIGS. 1, 5, 6 and 10, the horizontal plane 40 preferably includes an aperture 41 defined for identifying the type of comb 10 that is being used with the clipper 11, because different desired hair styles or lengths generally require different types or sizes of combs. Conventional combs generally have a protrusion or etching on the comb indicating the type of comb being used, where the protrusion or etching is integrally formed with the comb. However, this form of identification can be difficult to see because it is the same material and color as the comb. Accordingly, it is contemplated that the aperture 41, preferably formed in the shape of a number associated with the size of the comb, will enable the user to more easily identify the comb 10, due to its visibility on the comb.

Figure 2:
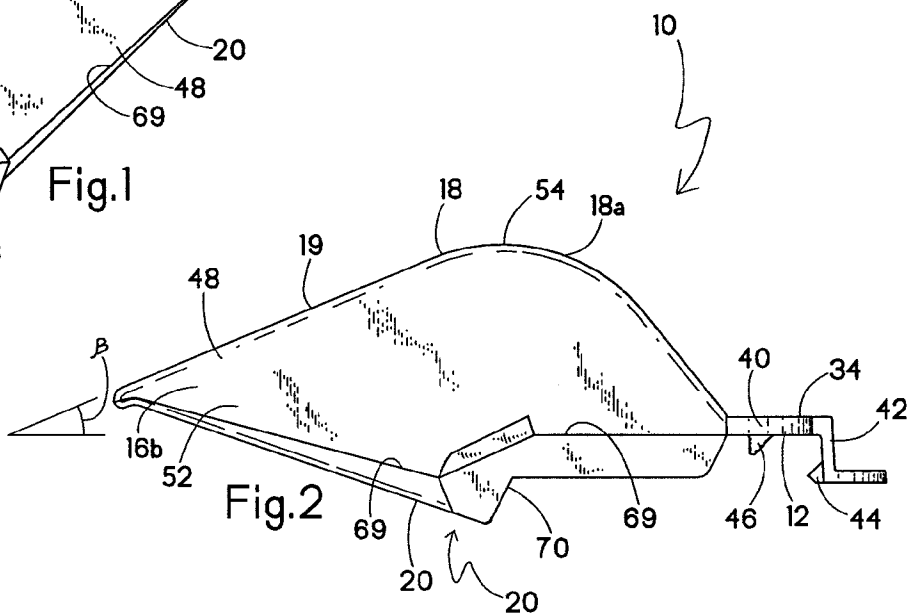
FIG. 2 is a side elevational view of the attachment comb of FIG. 1.
Figure 9:
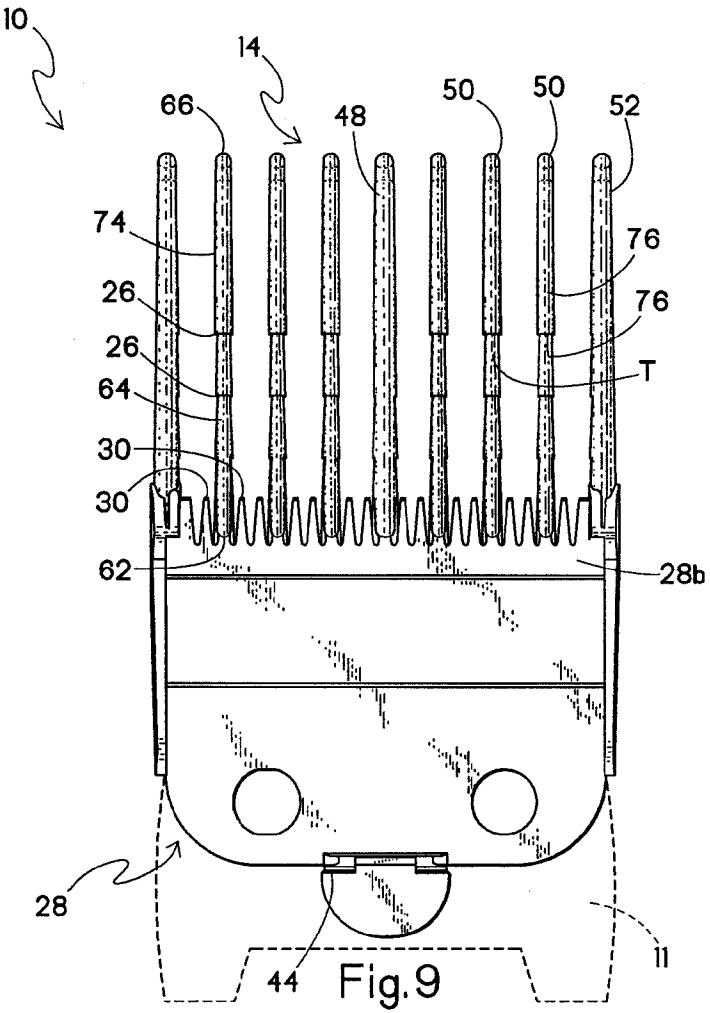
FIG. 9 is a bottom view of the assembly of FIG. 8.

Referring to FIGS. 2 and 9, the rear edge 34 includes a tab 42 extending generally perpendicular to the horizontal plane 40 and having a tongue 44 arranged generally parallel to the horizontal plane. The tongue 44 is constructed and arranged for engaging the blade set 28 as is well known in the art. The base portion 12 also preferably includes a pair of projections 46 arranged near the rear edge 34 and configured for facilitating the engagement of the tongue 44 upon the blade set 28. The tongue 44 and the projections 46 provide a secure and removable mounting of the base portion 12 on the blade set 28. However, it is appreciated that other arrangements for attaching the base portion 12 to the blade set 28 may be suitable, as known in the art.

As shown in FIGS. 1, 3, 4 and 9, the plurality of teeth 14 includes a plurality of full teeth 48 and a plurality of intermediate teeth 50, wherein the plurality of full teeth includes a pair of outer teeth 52. Each of the full, intermediate and outer teeth 48, 50, 52 has a distinct configuration. While other arrangements are contemplated, one of the full teeth 48 has a group of intermediate teeth 50 on each side. Preferably still, the plurality of teeth 14 includes three full teeth 48 and six intermediate teeth 50; however the number of teeth may vary to suit the application. The outer teeth 52 are constructed and arranged for retaining hair within the comb 10, as known in the art.

It is contemplated that by providing the comb 10 with nine teeth (versus seven teeth traditionally found in hair clipper combs), feeding of hair to the blade set 28 is enhanced, and added comfort is provided to the person whose hair is being cut, because the additional teeth provide the feeling of a conventional grooming comb as it is pushed along the scalp.

Preferably, a body portion 16*a* of each of the intermediate teeth 50 has a reduced volume compared to a body portion 16*b* of the full teeth 48. In the depicted embodiment, the body portion 16*a* of each of the intermediate teeth 50 has less than one-half the volume of the body portion 16*b*. It is contemplated that the present arrangement of full and intermediate teeth 48, 50 improves the feeding of hair during use of the clipper 11, allowing more or most of the hair to be fed through the teeth 14 and to the blade teeth 30, providing a uniform cut. It is further contemplated that because of the alternating geometry of the full and intermediate teeth 48, 50, less material is necessary to manufacture the comb 10, resulting in a lower production cost and a lower weight. Accordingly, due to the decreased weight of the comb 10, a user can more easily maneuver the comb through the hair to be cut, without detracting from the overall support the teeth provide to the hair being cut.

Best shown in FIG. 1, an upper peripheral edge 18*a* of each of the full teeth 48 includes a convex curved surface 54. An upper peripheral edge 18*b* of each of the intermediate teeth 50 includes a concave curved surface 56. It is contemplated that the concave curved surface 56 will aid in guiding hair toward the blade set 28 for cutting. The convex curved surface 54 is constructed and arranged to prevent hair from falling outside the cutting area of the comb 10, essentially acting as walls to hold the hair within the comb.

Figure 7:
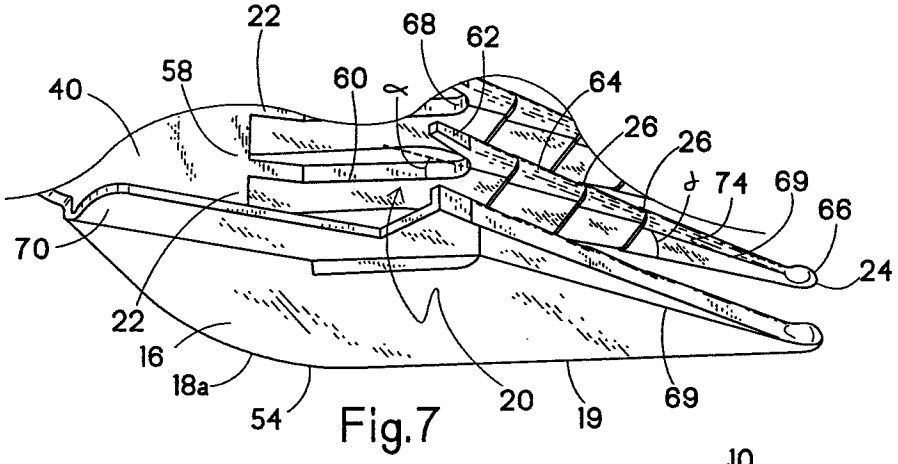
FIG. 7 is a bottom perspective view of the attachment comb of FIG. 1.
Figure 6:
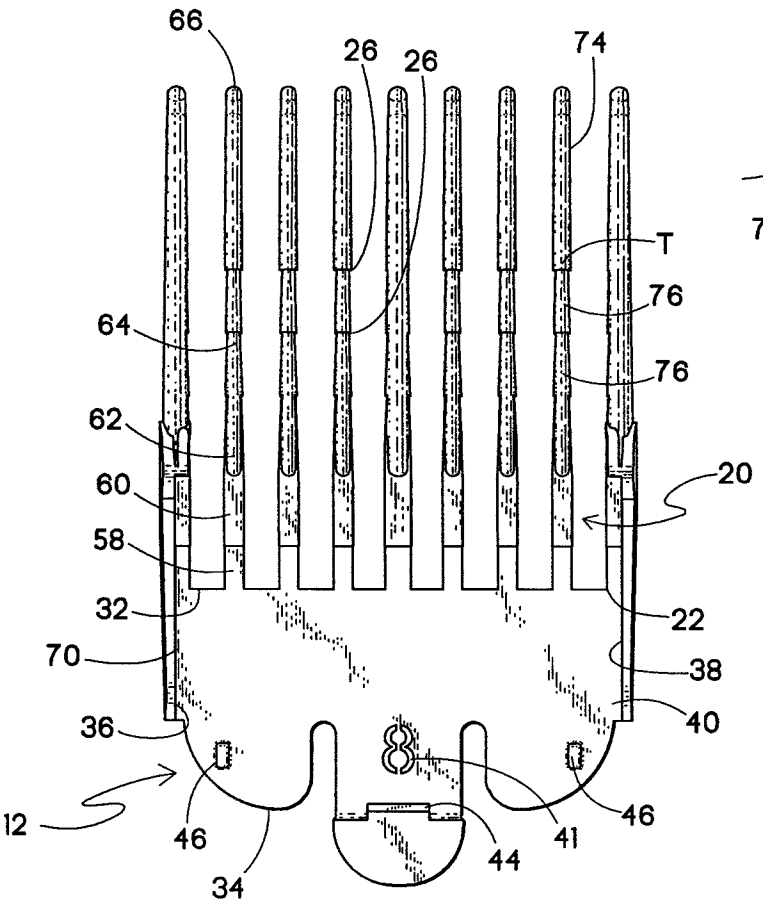
FIG. 6 is a bottom view of the attachment comb of FIG. 1.

As seen in FIGS. 6 and 7, the lower peripheral edge 20 of each of the plurality of full and intermediate teeth 48, 50 includes a first portion 58 adjacent the proximal end 22, a second portion 60 arranged at an oblique angle to the first portion, a blade overhang 62 adjacent the second portion, and an edge portion 64 connecting the blade overhang to a finger portion 66 at the distal end 24. The first portion 58 is preferably arranged parallel to the horizontal plane 40, best seen in FIG. 7.

Preferably, and as shown in FIGS. 1 and 7, the finger portion 66 is curved and forms an oblique angle with the edge portion 64 at the distal end 24. It is contemplated that this arrangement will provide more comfort to the person whose hair is being cut, because the finger 66 has a curved and radiused end rather than a pointed end, which in some cases has been found to scratch the scalp and cause discomfort. Further, during injection molding of the comb 10, it is contemplated that a parting line 69 (formed on the comb during molding) is located offset from the edge 64, extends along a tooth sidewall and is located above the finger portion 66 and free of contact with the user's scalp, as shown in FIGS. 1, 2 and 7. It is further contemplated that the parting line 69 conforms to the curved shape of the finger portion 66, which further prevents the parting line from contacting the user's scalp during operation. This is contrary to most current combs, where the parting line forms an edge on the comb teeth that can scratch the scalp.

As seen in FIGS. 7 and 9, the blade overhang 62 is preferably arranged at an approximate 45° angle $\alpha$ relative to the second portion 60. The blade overhang 62 and the second portion 60 meet at a radiused corner 68. It is contemplated that the lack of sharp edges on the radiused corner 68 will allow hair to exit the comb 10 after cutting. The end of the blade overhang 62 is also preferably radiused and is configured for preventing hair from becoming tangled or caught upon it. The blade overhang 62 is constructed and arranged so that there is clearance between the overhang and the blade teeth 30 during hair cutting.

Referring to FIG. 9, it is preferred that upon engagement of the blade set 28 with the base portion 12, the teeth 14 are in alignment with corresponding blade teeth 30. It is contemplated that this arrangement will allow more hair to be cut than in conventional combs, because the teeth 14, and more specifically, the blade overhang 62, does not interfere with the cutting zone defined by an area of overlap of the blade teeth 30 of the blades 28*a*, 28*b*.

Referring now to FIGS. 2 and 7, a feature of the present comb is that the blade teeth 30 are maintained in a generally perpendicular orientation to the hair strands being cut. This orientation has been found to provide more efficient cutting and increased comfort to the user or stylist. To obtain this generally perpendicular orientation, a distal edge portion 19 of the upper peripheral edge 18*a* is preferably parallel to the second portion 60. (FIG. 7). Further, the distal edge portion 19 and the horizontal plane 40 define an angle $\beta$ of approximately 15-25° (FIG. 2). It is preferred that $\beta$ be approximately 23°. It is further contemplated that by arranging the second portion 60, the distal edge portion 19 and the horizontal plane 40 in the above manner, during operation the blade teeth 30 will remain perpendicular to the hair being cut, providing a more uniform cut. Also, the size of angles $\alpha$, $\beta$ may vary to suit the application.

Turning now to FIGS. 1, 2 and 6, 7 and 9, each of the outer teeth 52 includes a shoulder portion 70 at the proximal end 22 defining a planar wall extending generally perpendicularly from the base portion 12 and being constructed and arranged for guiding and maintaining alignment between the blade set 28 and the base portion. The shoulder portion 70 is preferably coplanar with the corresponding outer tooth 52. However, it is appreciated that other alignment or guiding arrangements may be suitable.

Referring now to FIGS. 1 and 6-8, the plurality of spaced, preferably parallel retaining formations 26, here ridges, extend from the upper peripheral edge 18 to the edge portion 64, the ridges being arranged at an acute angle γ (FIG. 7) relative to the distal end 24 and the edge portion. When viewed from the finger portion 66, the first of the ridges 26 is located at a point approximately one-half the length of the edge portion 64, and the last of the ridges is located at a point near the blade overhang 62. It is contemplated that this arrangement is most effective at retaining the hair within the clipper 10. However, it is appreciated that the ridges 26 may be formed at different points on the edge portion 64, depending on the application.

Best shown in FIGS. 1, 5 and 6, the body portion 16 of each of the teeth 48, 50 includes a pair of sidewalls 74, and the ridges 26 are preferably formed on both of the sidewalls of each of the teeth 48, 50. The ridges 26 define a series of wedges 76 when viewed from the lower peripheral edge 20 or from the upper edge 18. Also, it is preferred that the ridges 26 on adjacent teeth 14 are aligned with each other.

Being constructed and arranged for preventing hair from falling out of the comb 10 before it is cut, the ridges 26 catch or retain the hair as it is being fed through the comb 10. More specifically, as seen in FIGS. 6 and 9, when viewed from the bottom, the ridges 26 are each defined by an abrupt narrowing of a thickness 'T' of the teeth 14. The tooth 14 then gradually thickens to form the next adjacent ridge 26. While ridges are preferred in the present comb 10, it is contemplated that other hair retention formations 26 may be provided which slightly increase the coefficient of friction without excessively impeding the passage of the comb through the hair. In current combs, the sides of the teeth have a generally smooth surface, and accordingly, as hair is fed through the comb, there is nothing to retain the hair within the comb as it moves along the scalp. Thus, some of the hair can fall out of the comb prior to cutting. In contrast, in the present comb 10, as the hair moves toward the blade teeth 30, it is caught by the ridges 26, preventing hair from falling out of the comb until after it has been cut.

As the comb 10 continues along the scalp, hair passes the first of the ridges 26. However, before the hair can fall out of the comb 10, it meets the next of the ridges 26, and so on, until the hair reaches the blade set 28 and can be cut by the blade teeth 30. It is contemplated that the current spacing between the ridges 26 allows a significant amount of hair to be cut and prevents the hair from falling out of the comb 10 before it is cut. However, it is appreciated that other structures may be suitable instead of the ridges 26, such as textured cross-hatching or raised bumps, as known in the art.

Accordingly, the present attachment comb 10 prevents hair from falling out of the comb prior to cutting by providing at least one formation 26 configured for retaining the hair. Further, the present attachment comb 10 includes both intermediate and full teeth 48, 50, thus requiring less material to manufacture and resulting in a lighter weight comb. Also, the base portion 12 of the present attachment comb is constructed and arranged for preventing hair back-up on the base portion during cutting. Finally, the intermediate and full teeth 48, 50 of the present attachment comb are constructed and arranged to allow hair to more easily exit the comb after being cut. It has also been noted that the present comb 10 has been found to cut more hair per pass than conventional combs.

While a particular embodiment of the present attachment comb has been described herein, it should be appreciated by those skilled in the art that changes and modifications may be made thereto without departing from the invention in its broader aspects and as set forth in the following claims.

The invention claimed is:

1. An attachment comb for a hair clipper comprising:

a base portion constructed and arranged for releasably engaging the hair clipper; and a plurality of teeth extending from said base portion, each of said teeth including a body portion defined between an upper peripheral edge and a lower peripheral edge, a proximal end adjacent said base portion and a distal end at an opposite end thereof, wherein said body portion includes a pair of sidewalls extending from said upper peripheral edge to said lower peripheral edge, and on each of said teeth, at least one of said sidewalls is provided with at least one formation for retaining hair in the comb prior to cutting, said at least one formation includes a plurality of linearly extending ridges extending generally transverse to a longitudinal axis of said corresponding teeth and projecting from a surface of said corresponding sidewall for catching and retaining hair being fed through the comb, and increasing a coefficient of friction of the teeth, thus obstructing the flow of hair along the teeth from said distal end to said proximal end, said ridges being disposed exclusively within said body portion.

2. The attachment comb of claim 1 wherein said ridges define a series of wedges when viewed from said lower peripheral edge.

3. The attachment comb of claim 1 wherein said plurality of ridges on adjacent teeth are aligned with each other.

4. The attachment comb of claim 1 wherein each of said plurality of ridges are spaced apart from and generally parallel to each other on said body portion of each of said plurality of teeth.

5. The attachment comb of claim 1 wherein each of said plurality of teeth includes a plurality of said ridges on said body portion and said ridges being arranged at an acute angle relative to said lower peripheral edge.

6. The attachment comb of claim 1 wherein said lower peripheral edge of said plurality of teeth each includes a first portion adjacent said proximal end, a second portion arranged at an oblique angle to said first portion, a blade overhang adjacent said second portion, and an edge portion connecting said blade overhang to a finger portion at said distal end.

7. The attachment comb of claim 6 wherein said blade overhang is arranged at an approximate 45° angle relative to said second portion.

8. The attachment comb of claim 6 wherein said at least one formation includes a plurality of ridges beginning at a point approximately one-half the length of said edge portion, and end at a point near said blade overhang.

9. The attachment comb of claim 1 wherein said plurality of teeth includes a plurality of full teeth and a plurality of intermediate teeth, wherein said plurality of full teeth includes a pair of outer teeth, each of said full, intermediate and outer teeth having a distinct configuration, said body portion of said intermediate teeth having a reduced volume of said body portion compared to said full teeth.

10. The attachment comb of claim 9 wherein said upper peripheral edge of each of said full teeth includes a convex curved surface.

11. The attachment comb of claim 9 wherein said upper peripheral edge of each of said intermediate teeth includes a concave curved surface.

12. The attachment comb of claim 9 wherein each of said outer teeth includes a shoulder portion at said proximal end, said shoulder portion defining a planar wall extending generally perpendicularly from said base portion and being constructed and arranged for guiding a blade set onto said base portion.

13. The attachment comb of claim 1 wherein said base portion includes an aperture defining a symbol for indicating to a user at least one of the type and size of attachment comb being utilized.

14. An attachment comb for a hair clipper, comprising:

a base portion constructed and arranged for releasably engaging the hair clipper;

a plurality of teeth extending from said base portion, each of said teeth including a body portion defined between an upper peripheral edge and a lower peripheral edge, a proximal end adjacent said base portion and a distal end at said base portion includes an integrally formed aperture defining the shape of a symbol for indicating to a user the size of attachment comb being utilized.

* * * * *